US008951073B2

(12) United States Patent
Zhang

(10) Patent No.: US 8,951,073 B2
(45) Date of Patent: Feb. 10, 2015

(54) AUDIO JACK CONNECTOR PREVENTING GROUNDING CONTACT FROM DEFLECTION

(71) Applicant: Hon Hai Precision Industry Co., Ltd., New Taipei (TW)

(72) Inventor: Wei-De Zhang, Shenzhen (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 141 days.

(21) Appl. No.: 13/834,476

(22) Filed: Mar. 15, 2013

(65) Prior Publication Data

US 2013/0244497 A1 Sep. 19, 2013

(30) Foreign Application Priority Data

Mar. 16, 2012 (CN) ..... 2012 1 0070024
Mar. 16, 2012 (CN) ..... 2012 1 0070037

(51) Int. Cl.

| | |
|---|---|
| ***H01R 24/00*** | (2011.01) |
| ***H01R 13/64*** | (2006.01) |
| ***H01R 13/41*** | (2006.01) |
| ***H01R 24/58*** | (2011.01) |
| *H01R 12/71* | (2011.01) |

(52) U.S. Cl.

CPC ..... *H01R 13/64* (2013.01); *H01R 13/41* (2013.01); *H01R 24/58* (2013.01); *H01R 12/716* (2013.01)

USPC ..... 439/676

(58) Field of Classification Search

USPC ..... 439/676, 668–669, 188, 108, 95, 101, 439/939, 607.4

See application file for complete search history.

(56) References Cited

U.S. PATENT DOCUMENTS

| | | | | |
|---|---|---|---|---|
| 6,093,058 | A * | 7/2000 | Wu | 439/607.35 |
| 6,220,898 | B1 * | 4/2001 | Wu | 439/668 |
| 6,224,408 | B1 * | 5/2001 | Wu | 439/188 |
| 6,575,793 | B1 * | 6/2003 | Li et al. | 439/668 |
| 7,901,253 | B2 | 3/2011 | Yudate | |
| 2008/0299837 | A1 * | 12/2008 | Long et al. | 439/676 |

FOREIGN PATENT DOCUMENTS

| | | |
|---|---|---|
| CN | 2428878 | 5/2001 |
| CN | 2916982 | 6/2007 |
| CN | 201323354 | 10/2009 |
| CN | 201789147 U | 4/2011 |
| CN | 201797146 | 4/2011 |
| CN | 202103223 U | 1/2012 |

* cited by examiner

*Primary Examiner* — Jean F Duverne

(74) *Attorney, Agent, or Firm* — Ming Chieh Chang; Wei Te Chung

(57) ABSTRACT

An audio jack connector (100) includes an insulative housing (1) and a number of contacts (2) retained in the insulative housing. The insulative housing defines a receiving channel (14) and a number of terminal passageways (121). The contacts include a grounding contact (25, 25') having a retaining portion (256; 256') retained in the corresponding terminal passageway, a contacting portion (257; 257') extending from the retaining portion into the receiving channel, a soldering portion (258; 258') coplanar with a mounting face of the insulative housing, and a connecting portion (259; 259') vertically connected between the retaining portion and the soldering portion. The connecting portion forms an auxiliary portion (2591; 2591'). Both the auxiliary portion and the retaining portion engage with the insulative housing.

15 Claims, 9 Drawing Sheets

AUDIO JACK CONNECTOR PREVENTING GROUNDING CONTACT FROM DEFLECTION

CROSS-REFERENCE TO RELATED APPLICATIONS

This patent application relates to a U.S. Patent Application filed on Mar. 15, 2013, having an unknown serial number, and entitled "AUDIO JACK CONNECTOR WITH SMALL SIZE FOR SPACE SAVING", which is assigned to the same assignee as this application.

BACKGROUND OF THE INVENTION

1. Field of the Invention

The present invention relates generally to an audio jack connector, and more particularly to an audio jack connector preventing grounding contact from deflection to achieve a better grounding effect.

2. Description of Related Arts

Electrical device such as mobile phone, MP3, and etc, usually has an audio jack connector for receiving an audio plug. The audio jack connector comprises an insulative housing and a plurality of contacts retained in the insulative housing. The insulative housing defines a receiving channel and a plurality of passageways communicating with the receiving channel. The contacts are retained in the passageways. The contacts have a grounding contact. In order to achieve a better grounding purpose, the grounding contact is usually arranged nearest to an insertion opening of the insulative housing such that the grounding contact contacts with the inserted audio plug prior to other contacts. The contacts are usually assembled to the insulative housing along a rear-to-front direction for assembling facilitation and soldering facilitation. Therefore, in order to achieve a better waterproof function, it is better to avoid forming unnecessary cutouts on other faces except for the rear face opposite to the insertion opening. Therefore, the grounding contact extends a large length from the front face to the rear face, making the grounding contact tend to deflect. The connection between the soldering portion of the grounding contact and the printed circuit board may be damaged and the grounding effect is influenced.

Hence, an audio jack connector preventing deflection and having better grounding effect is desired.

SUMMARY OF THE INVENTION

Accordingly, an object of the present invention is to provide an audio jack connector preventing deflection and having better grounding effect.

To achieve the above object, an audio jack connector includes an insulative housing and a number of contacts retained in the insulative housing. The insulative housing defines a receiving channel and a number of terminal passageways. The contacts includes a grounding contact having a retaining portion retained in the corresponding terminal passageway, a contacting portion extending from the retaining portion into the receiving channel, a soldering portion coplanar with a mounting face of the insulative housing, a connecting portion vertically connected between the retaining portion and the soldering portion. The connecting portion forms an auxiliary portion. Both the auxiliary portion and the retaining portion engage with the insulative housing.

Other objects, advantages and novel features of the invention will become more apparent from the following detailed description when taken in conjunction with the accompanying drawings.

DETAILED DESCRIPTION OF THE PREFERRED EMBODIMENT

Figure 1:
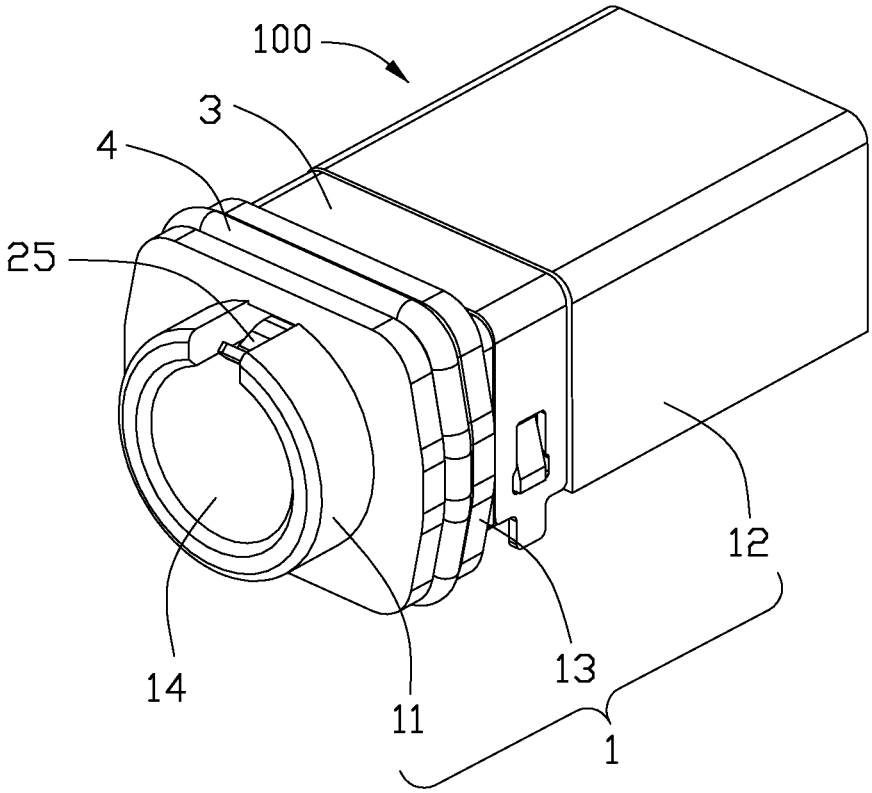
FIG. 1 is a perspective, assembled view of an audio jack connector in a first embodiment according to the present invention.
Figure 2:
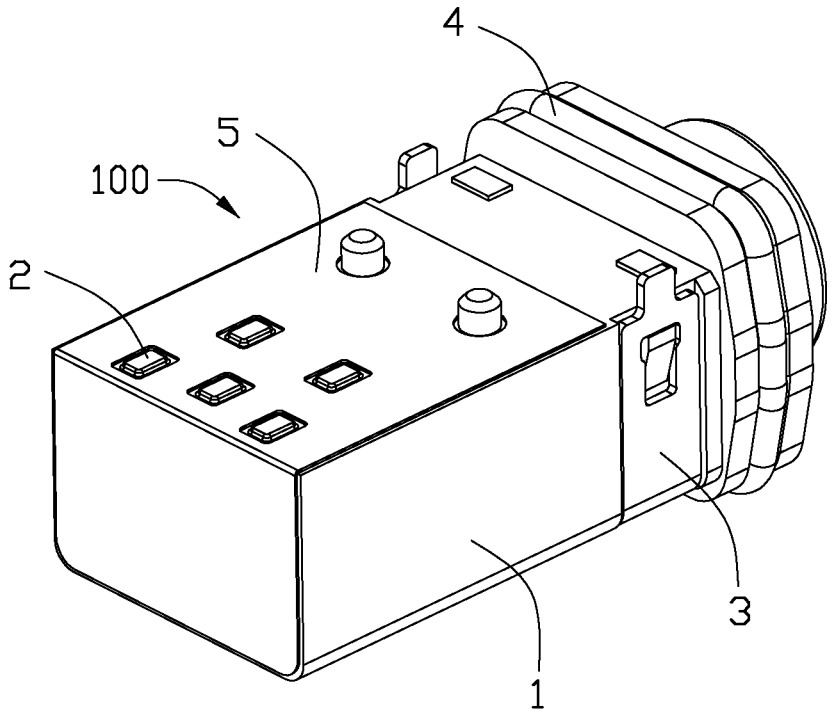
FIG. 2 is another perspective, assembled view of the audio jack connector of FIG. 1.

Reference will now be made in detail to the two preferred embodiments of the present invention.

Referring to FIGS. 1 to 5, an audio jack connector 100 of a first embodiment of the present invention comprises an insulative housing 1, a plurality of contacts 2 retained in the insulative housing 1, a securing board 3 assembled to the insulative housing 1 for assembling the insulative housing 1 on a printed circuit board (not shown), a waterproof ring 4 encircling a front part of the insulative housing 1, and a waterproof film 5 attached to the insulative housing 1.

Figure 3:
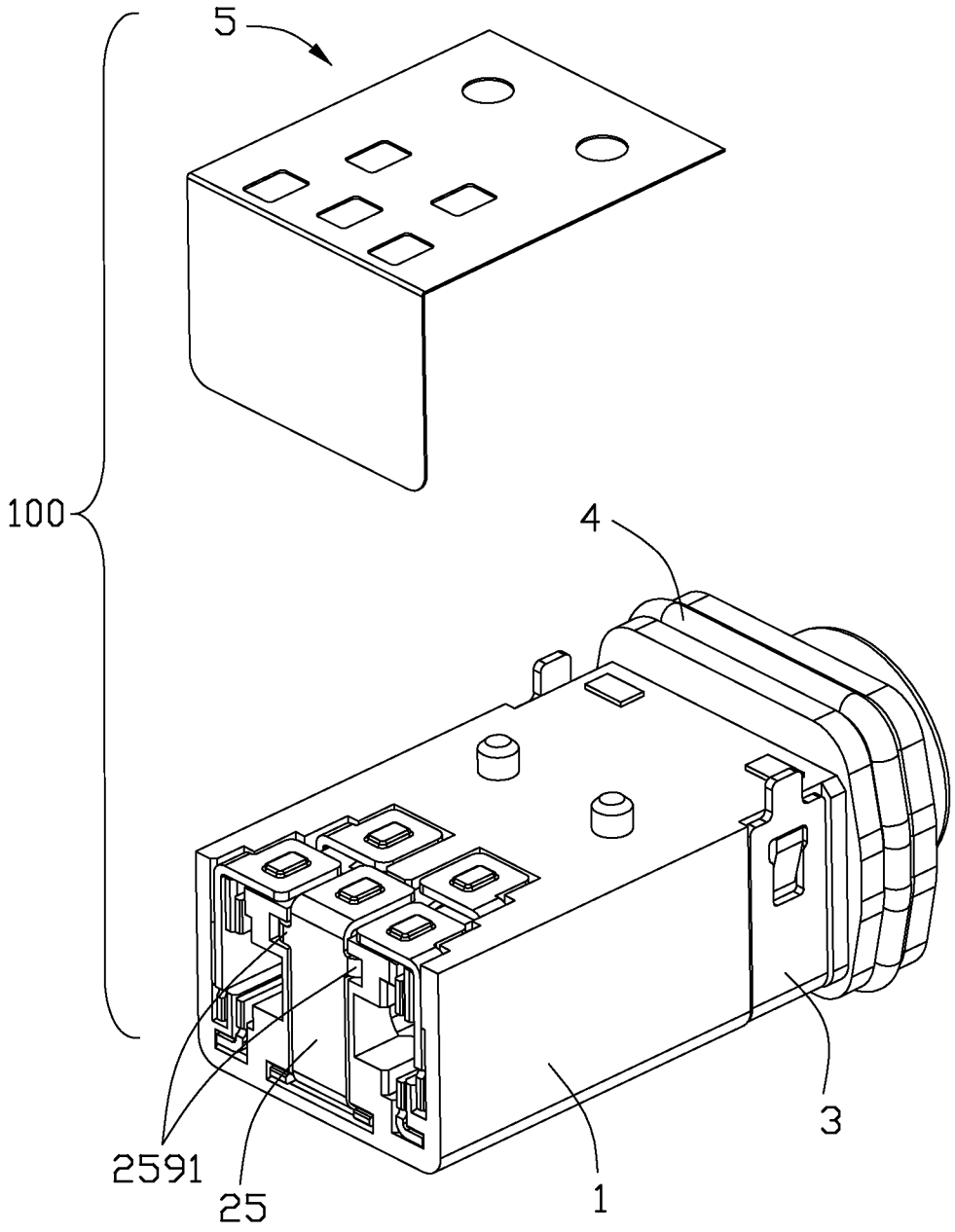
FIG. 3 is a perspective, partly exploded view of the audio jack connector of FIG. 1.
Figure 4:
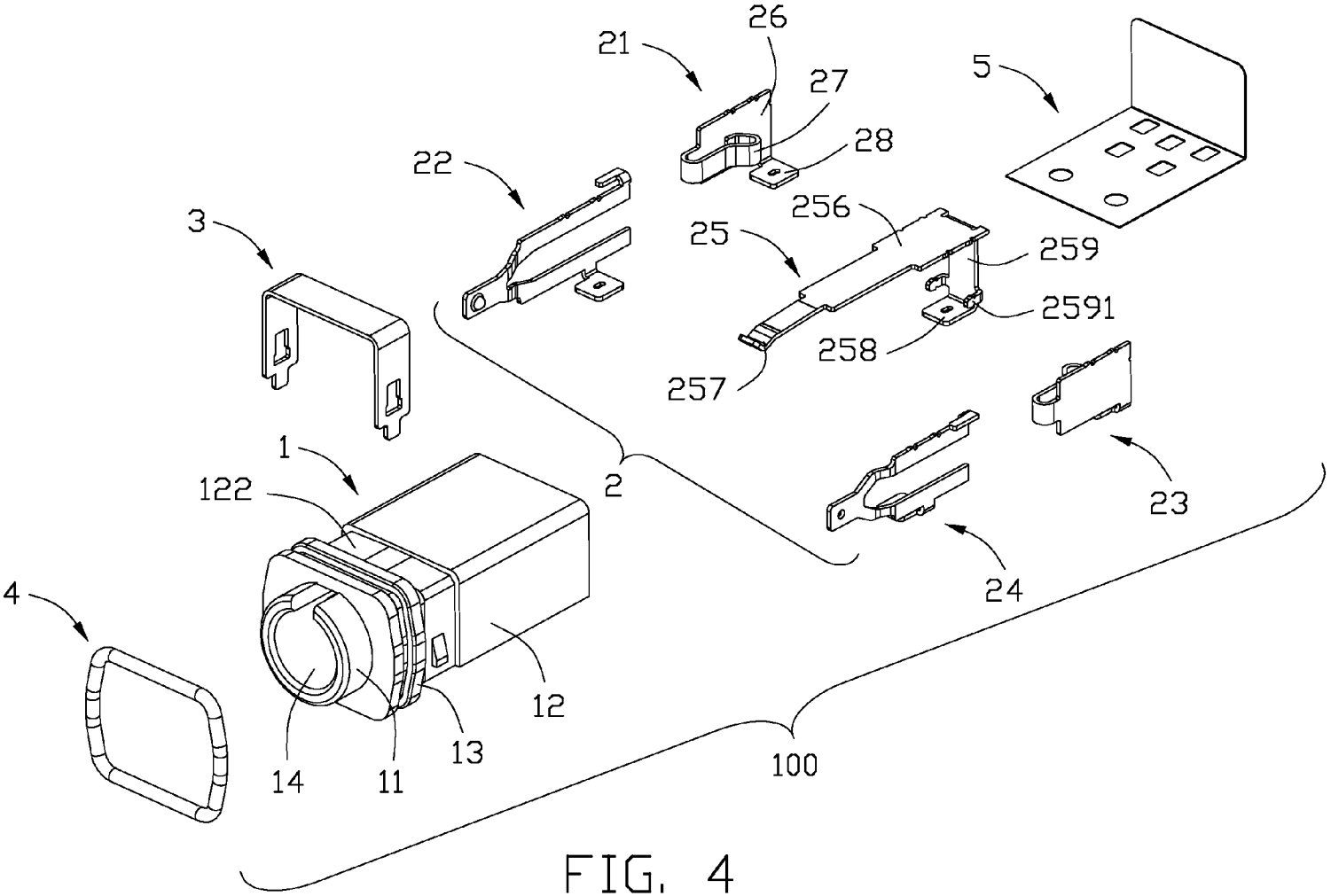
FIG. 4 is a perspective, fully exploded view of the audio jack connector of FIG. 1.
Figure 5:
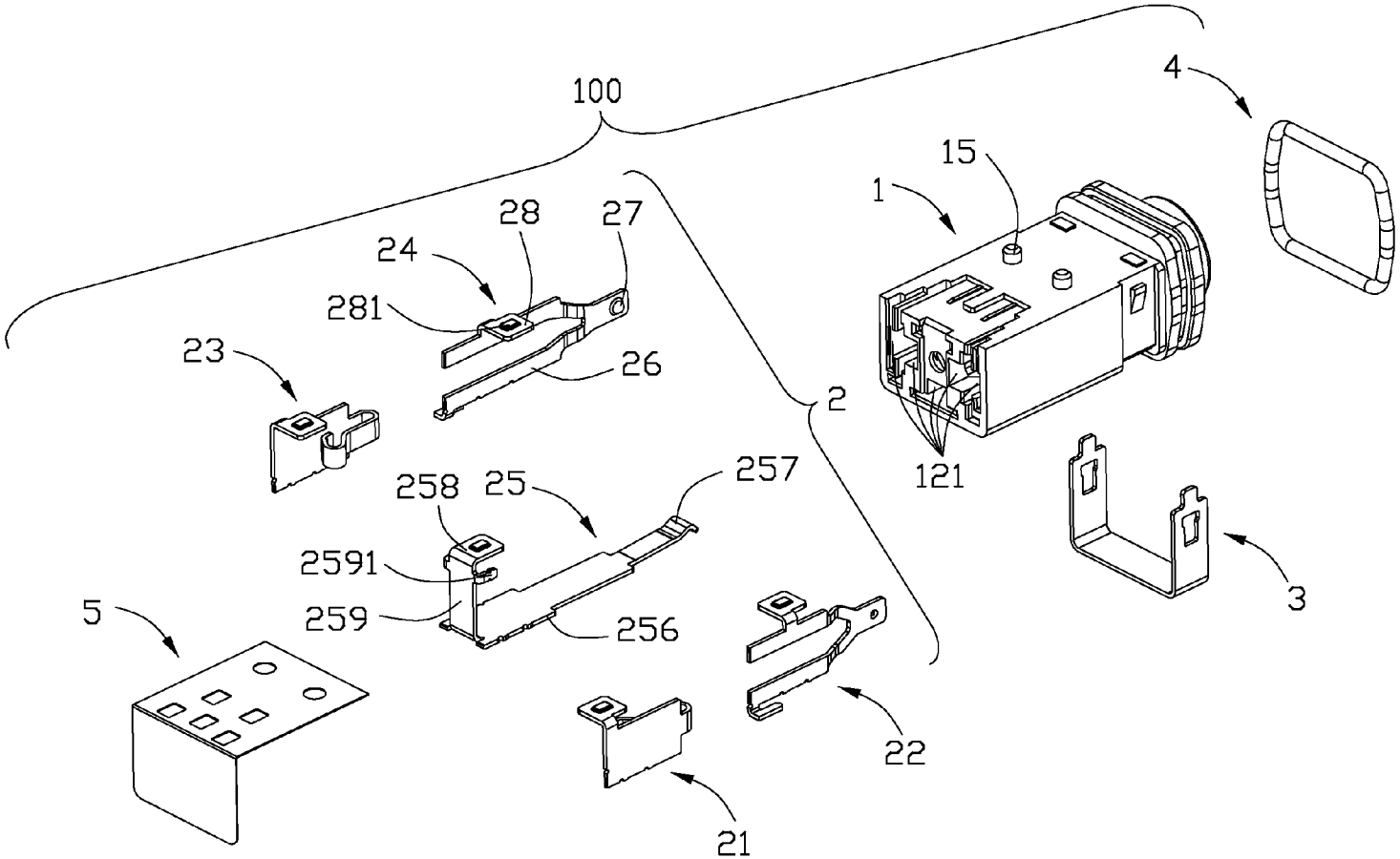
FIG. 5 is another perspective, fully exploded view of the audio jack connector of FIG. 1.
Figure 6:
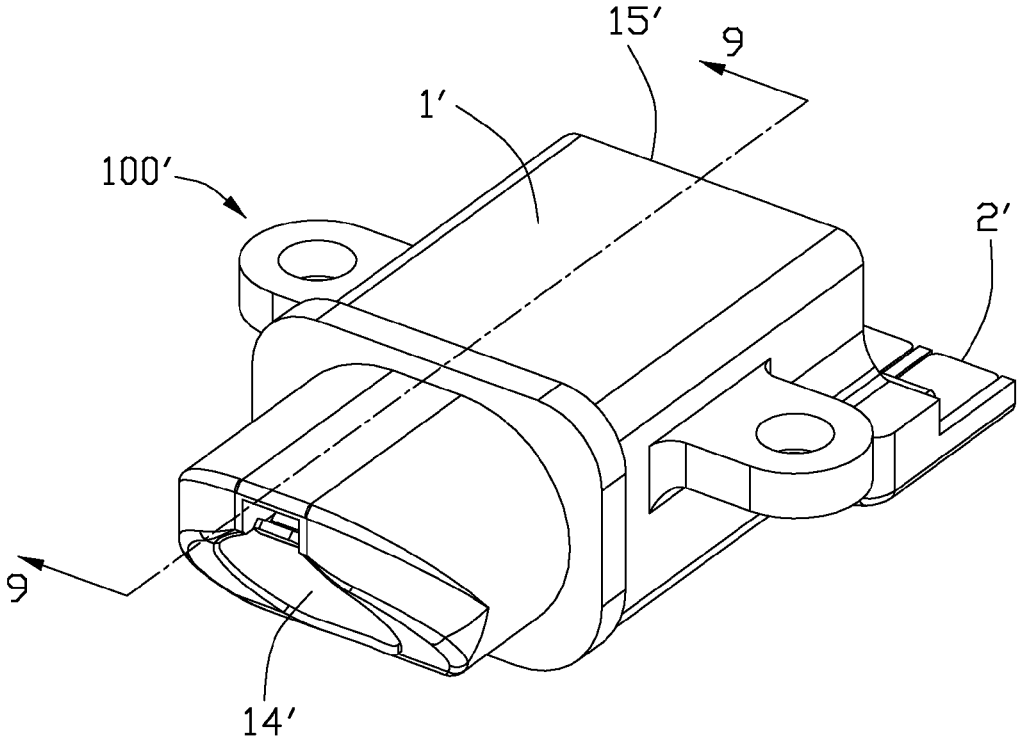
FIG. 6 is a perspective, assembled view of an audio jack connector in a second embodiment according to the present invention.
Figure 7:
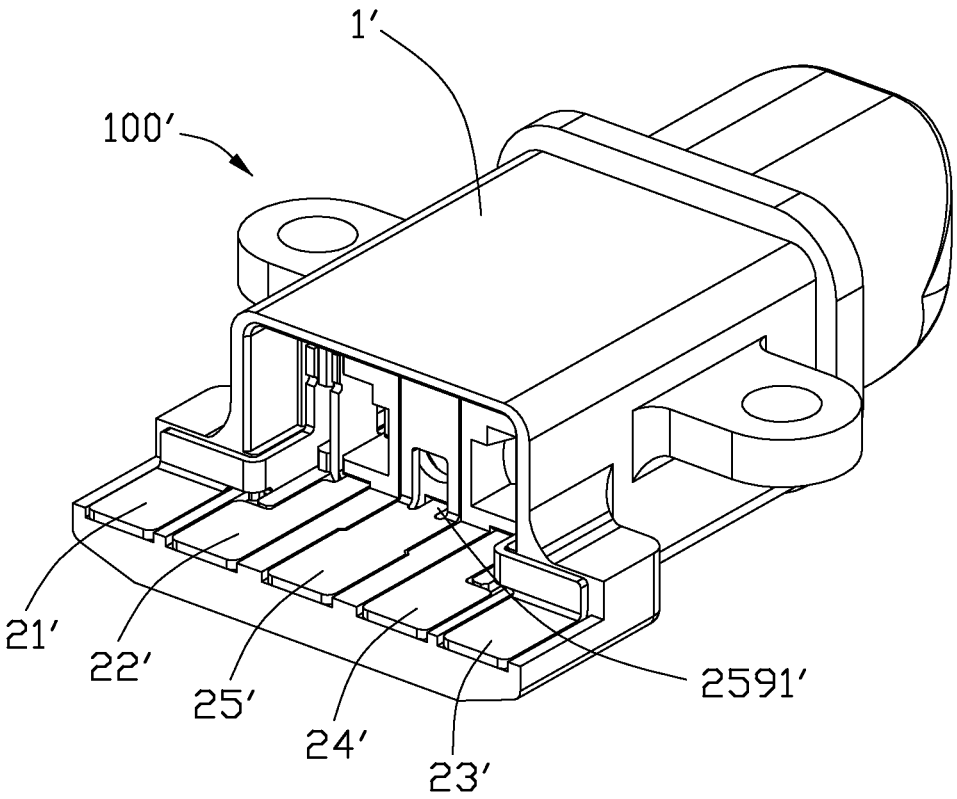
FIG. 7 is another perspective, assembled view of the audio jack connector of FIG. 6.

Referring to FIGS. 3-5, the insulative housing 1 comprises a circular head portion 11, a rectangular base portion 12, and a neck portion 13 connected between the head portion 11 and the base portion 12. The insulative housing 1 defines a receiving channel 14 extending through the head portion 11, the neck portion 13, and the base portion 12. The base portion 12 defines a plurality of terminal passageways 121 communicating with the receiving channel 14. The base portion 12 defines a recess portion 122 adjacent to the neck portion 13. The securing board 3 is secured in the recess portion 122. The neck portion 13 protrudes out of the head portion 11 and the base portion 12. The waterproof ring 4 is retained in the neck portion 13. The insulative housing 1 defines an insertion opening (not labeled) on the head portion 11 which communicates with the receiving channel 14, a rear face opposite to the insertion opening, and a mounting face abutting the printed circuit board. Therefore, a mating direction is defined by the insertion opening. The mounting face forms a pair of protrusions 15. The protrusions 15 and the securing board 3 are both fixed to the printed circuit board.

Referring to FIGS. 3 to 6, the contacts 2 comprises a first contact 21 and a second contact 22 both at a left side of the receiving channel 14, a third contact 23 and a fourth contact 24 both at a right side of the receiving channel 14, and a fifth contact 25 at an upper side of the receiving channel 14. Each of the contacts 2 comprises a retaining portion 26 retained in the corresponding terminal passageway 121, a contacting portion 27 extending from the retaining portion 26 into the receiving channel 14, and a soldering portion 28 exposed on the mounting face of the insulative housing 1. All of the soldering portions 28 are arranged at a rear part of the mounting face and in two lines for better adhesion of the waterproof film 5. Each soldering portion 28 forms a bulge 281 and the bulge 281 protrudes out of the waterproof film 5 for soldering on the printed circuit board. The bulges 281 are weldless with respect to the waterproof film 5 and therefore, waterproof effect is achieved.

Referring to FIGS. 3 and 4, the fifth contact 25 comprises a flatly and forwardly extending fifth retaining portion 256, a fifth contacting portion 257 extending forwardly from the fifth retaining portion 256 into the receiving channel 14, a fifth soldering portion 258 extending forwardly as the fifth retaining portion 256 but be arranged at a level lower than the fifth retaining portion 256 for being exposed on the mounting face of the insulative housing 1, and a vertically extending connecting portion 259 connected between the fifth retaining portion 256 and the fifth soldering portion 258. The fifth contact 25 is a grounding contact. Take a view along the mating direction, the fifth contacting portion 257 is the nearest to the insertion hole for timely releasing electrostatic charge. The fifth retaining portion 256 and the fifth contacting portion 257 extend along the mating direction and the connecting portion 259 extends along a vertical direction perpendicular to the mating direction. The connecting portion 259 further forms a pair of wing portions 2591 at lateral edges thereof which are engaged with the insulative housing 1 for preventing the connecting portion 259 from deflecting away from the insulative housing 1 which may induce that the fifth soldering portion 258 is not in a same planar surface as the other soldering portions 28, a missing solder may occur to the fifth contact 25, and a grounding effect is not guaranteed. The wing portions 2591 and the fifth retaining portions 256 interfere with the insulative housing 1 in two orthogonal directions. A first distance spaced between the wing portions 2591 and the fifth soldering portion 258 is smaller than a second distance spaced between the wing portions 2591 and the fifth retaining portion 256.

Because an assembling direction of all the contacts 2 is a rear-to-back direction opposite to the mating direction through the rear face, all the soldering portions 28 of the contacts 2 are coplanar with the mounting face of the insulative housing 1, the waterproof film 5 is adhered to at least the rear face of the insulative housing 1. Therefore, water is prevented from entering interior of electronic device which the audio jack connector 100 is assembled into.

The waterproof ring 4 is assembled on the neck portion 13. The waterproof ring 4 is compacted between the electronic device and the audio jack connector 100 and, therefore, water exterior of electronic device is prevented from entering into interior of the audio jack connector 100.

Therefore, the audio jack connector 100 of the present invention has a better waterproof effect.

Referring to FIGS. 6 to 9, an audio jack connector 100' of a second embodiment of the present invention comprises an insulative housing 1' and a plurality of contacts 2' retained in the insulative housing 1'.

Figure 8:
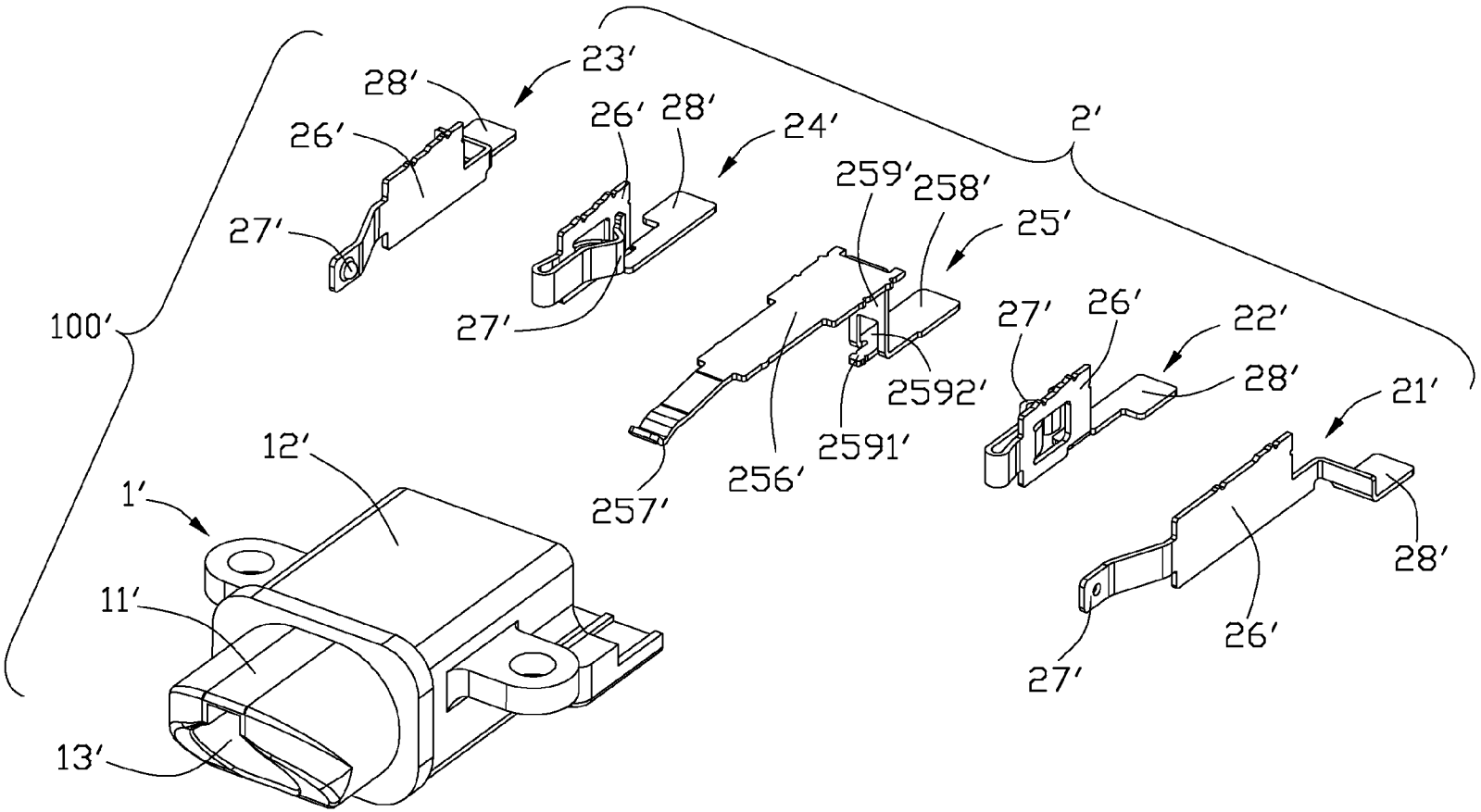
FIG. 8 is a perspective, partly exploded view of the audio jack connector of FIG. 6.
Figure 9:
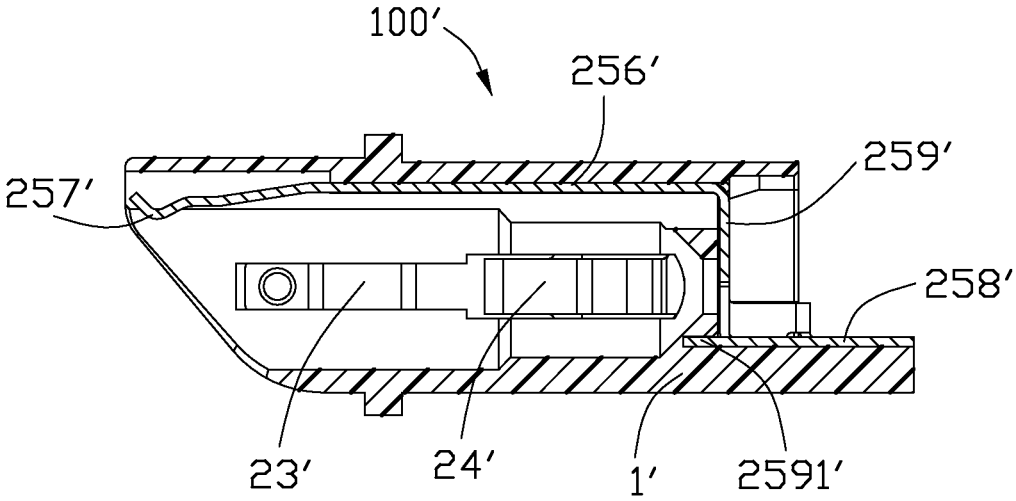
FIG. 9 is a cross-sectional view of the audio jack connector taken along line 9-9 in FIG. 6.

Referring to FIGS. 8-9, the contacts 2' comprises a grounding contact 25'. The grounding contact 25' comprises a flatly and forwardly extending fifth retaining portion 256', a fifth contacting portion 257' extending forwardly from the fifth retaining portion 256' into the receiving channel 14', a fifth soldering portion 258' extending forwardly as the fifth retaining portion 256' but be arranged at a level lower than the fifth retaining portion 256' for being exposed on the mounting face of the insulative housing 1', and a vertically extending connecting portion 259' connected between the fifth retaining portion 256' and the fifth soldering portion 258'. The fifth contact 25' is a grounding contact. Take a view along the mating direction, the fifth contacting portion 257' is the nearest to the insertion hole for timely releasing electrostatic charge. The fifth retaining portion 256' and the fifth contacting portion 257' extend along the mating direction and the connecting portion 259' extends along a vertical direction perpendicular to the mating direction. The connecting portion 259' further comprises an extension portion 2591' stamped therefrom and bent therefrom. Therefore, the connecting portion 259' has an aperture 2592' formed by making the extension portion 2591'. The extension portion 2591' preferably, oppositely extends with respect to the fifth soldering portion 258' in a same level. The extension portion 2591' is engaged with the insulative housing 1' for preventing the connecting portion 259' from deflecting away from the insulative housing 1' which may induce that the fifth soldering portion 257' is not in a same planar surface as the other soldering portions 28', a missing solder may occur to the fifth contact 25', and a grounding effect is not guaranteed. The extension portion 2591' and the fifth retaining portions 256' interfere with the insulative housing 1' in the same direction. The soldering portions 28' of the contacts 2' are arranged at a straight line outside of the insulative housing 1' and each soldering portion 28' has a sizable width and a sizable length for facilitating different connection methods, such as surface mounting technology, soldering with a cable, or etc. The fifth soldering portion 257' is arranged at a middle position of all of the soldering portions 28'.

In the audio jack connector 100' of the second embodiment of the present invention, a waterproof ring 4 added for encircling a front part of the insulative housing 1' and a waterproof film 5 added for attaching to a rear face of the insulative housing 1' as the first embodiment of the present invention are all right. Therefore, the audio jack connector 100' of the present invention has a better waterproof effect.

Because the pair of wing portions 2591 of the first embodiment and the extension portion 2591' of the second embodiment both function as an auxiliary portion to engage with the insulative housing 1, 1', the connecting portions 259, 259' are prevented from deflecting away from the insulative housing 1, 1'. All soldering portions 28, 258, 28', 258' are kept in coplanar. Lacking of solder between the fifth soldering portions 258, 258' and the printed circuit board is prevented. Therefore, grounding effect is guaranteed.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An audio jack connector comprising:

an insulative housing defining a receiving channel, a plurality of terminal passageways, an insertion opening, and a mating direction therealong; and a plurality of contacts retained in the insulative housing, the contacts including a grounding contact, the grounding contact having a retaining portion retained in a corresponding terminal passageway, a contacting portion extending from the retaining portion into the receiving channel, a soldering portion coplanar with a mounting face of the insulative housing, and a connecting portion vertically connected between the retaining portion and the soldering portion, the connecting portion forming an auxiliary portion, both the auxiliary portion and the retaining portion engaging with the insulative housing; wherein the auxiliary portion comprises an extension portion stamped and bent away from the connecting portion to extend along the mating direction; wherein the extension portion oppositely extends from the soldering portion of the grounding contact; wherein the soldering portions of all contacts are arranged at a straight line outside of the insulative housing and each soldering portion has a sizable width and a sizable length.

2. The audio jack connector as claimed in claim 1, wherein the auxiliary portion comprises a pair of wing portions at lateral edges of the connecting portion.

3. The audio jack connector as claimed in claim 2, wherein a first distance spaced between the wing portions and the soldering portion of the grounding contact is smaller than a second distance spaced between the wing portions and the retaining portion of the grounding contact.

4. The audio jack connector as claimed in claim 2, wherein the wing portions and the retaining portion of the grounding contact interfere with the insulative housing in two orthogonal directions.

5. The audio jack connector as claimed in claim 2, wherein the soldering portions of all contacts are arranged at a rear part of the mounting face and in two lines.

6. The audio jack connector as claimed in claim 1, wherein the connecting portion has an aperture correspondingly formed by making the extension portion.

7. The audio jack connector as claimed in claim 1, wherein the extension portion and the soldering portion are in a same level.

8. The audio jack connector as claimed in claim 1, further comprising a waterproof ring encircling the insulative housing.

9. The audio jack connector as claimed in claim 1, further comprising a waterproof film attached to at least a rear face of the insulative housing, and wherein the contacts are assembled to the insulative housing from the rear face.

10. An electrical connector comprising:

an insulative housing defining a receiving channel extending along a front-to-back direction with an insertion opening in a front side of the housing, a plurality of terminal passageways formed in the housing, each of said terminal passageways communicating transversely with the receiving channel, rearwardly with an exterior, and downwardly with an underside of the housing;

a plurality of contacts received in the corresponding terminal passageways, respectively, each of said contacts configured to be adapted to be forwardly assembled into the corresponding terminal passageway from a rear side of the housing and defining a front deflectable contacting section, a middle retaining section, a rear stopper section, and a bottom mounting section; wherein the front deflectable contacting section transversely extending into the receiving channel, the middle retaining section essentially defining a plate with barbs on at least one side edge thereof, the rear stopper section defines a structure forwardly forwardly abutting against a corresponding portion of the housing so as to prevent further movement of the contact relative to the housing, and the bottom mounting section located around a level of the underside and connected to the retaining section via a neck section; wherein said neck section is narrower than the mounting section.

11. The electrical connector as claimed in claim 10, wherein said structure is equipped with a tab forwardly extending into a corresponding hole of the housing in an interference fit.

12. The electrical connector as claimed in claim 10, wherein the underside of the housing defines a commonly recess in which all said mounting sections of the contacts are disposed.

13. The electrical connector as claimed in claim 10, wherein said terminal passageways are located transversely by two opposite sides of the receiving channel.

14. The electrical connector as claimed in claim 10, wherein said mounting sections are fully protectively located under said underside.

15. An electrical connector comprising:

an insulative housing defining a receiving channel along a front-to-back direction with an insertion opening in a front side of the housing;

two pairs of side contacts and one central contacts disposed in the housing and categorized with an inner contact and an outer contact in each pair, each of said side contacts defining a front contacting section extending into the receiving channel, a middle vertical planar retaining section with barbs on edges, a horizontal mounting section upwardly exposed to an exterior on a platform formed on a rear side of the housing, and a connecting section linked between the vertical planar retaining section and the horizontal mounting section; wherein the connecting section of the inner contact extends in a horizontal plane while the connecting section of the outer contact extends in an upstanding plane; wherein said central grounding contact defines a horizontal retaining section and a vertical connecting section between a deflectable contacting section, which extends into the receiving channel, and a horizontal mounting section which is mounted to the platform.

* * * * *